US008118366B2

(12) United States Patent
Matveev

(10) Patent No.: US 8,118,366 B2
(45) Date of Patent: Feb. 21, 2012

(54) CHAIR (VARIANTS)

(75) Inventor: Kirill Vladimirovich Matveev, Perm (RU)

(73) Assignee: Kirill Vladimirovich Matveev, Perm (RU)

( * ) Notice: Subject to any disclaimer, the term of this patent is extended or adjusted under 35 U.S.C. 154(b) by 0 days.

(21) Appl. No.: 12/507,183

(22) Filed: Jul. 22, 2009

(65) Prior Publication Data

US 2010/0176637 A1 Jul. 15, 2010

Related U.S. Application Data

(63) Continuation of application No. PCT/RU2007/000411, filed on Jul. 31, 2007.

(30) Foreign Application Priority Data

Jan. 23, 2007 (RU) ..... 2007102449
Jan. 23, 2007 (RU) ..... 2007102451

(51) Int. Cl.
*A47C 1/00* (2006.01)

(52) U.S. Cl. ..... 297/313; 297/331; 297/332; 297/335

(58) Field of Classification Search ..... 297/284.3, 297/284.4, 313, 331, 332, 337, 335, 336, 297/353, 354.1, 354.12
See application file for complete search history.

(56) References Cited

U.S. PATENT DOCUMENTS 1,415,252 A * 5/1922 McManis et al. ..... 297/423.15
3,989,297 A * 11/1976 Kerstholt ..... 297/300.3
4,270,797 A 6/1981 Brauning
4,786,105 A * 11/1988 Sheehan et al. ..... 297/271.6
4,889,387 A * 12/1989 Gregory ..... 297/452.27
5,330,254 A * 7/1994 Larson ..... 297/354.11
5,401,077 A * 3/1995 Hosoe ..... 297/312
5,501,507 A * 3/1996 Hummitzsch ..... 297/284.4
5,536,067 A * 7/1996 Pinto ..... 297/284.11

(Continued)

FOREIGN PATENT DOCUMENTS

BE 817904 A1 1/1975

(Continued)

OTHER PUBLICATIONS

International Search Report, mailed Oct. 25, 2007, from International Application No. PCT/RU2007/000411, filed on Jul. 31, 2007.

(Continued)

*Primary Examiner* — David Dunn
*Assistant Examiner* — Philip Gabler
(74) *Attorney, Agent, or Firm* — Houston Eliseeva, LLP

(57) ABSTRACT

The device is embodied in four variants. The home chair comprises a three-dimensional frame with a seat pivotally connected thereto in such a way that it is tiltable forward and up-and-down, a seat arresting device, a smooth displacement compensator, a reset mechanism embodied in the form of an oil-gas damper and a backrest, the tilt angle with respect to the seat is less than 90° and the distance between the top edge and the seat is less than 250 mm. The school variant is provided with a smooth displacement compensator and a reset mechanism embodied in the form of a spring. The child variant is adjustable in the vertical and horizontal planes, thereby making it possible to select the optimal sitting parameters of a child during the growth thereof, and comprises a seat provided with a tilt angle adjusting unit, a smooth displacement compensator and a reset mechanism.

10 Claims, 3 Drawing Sheets

U.S. PATENT DOCUMENTS

| | | | | |
|---|---|---|---|---|
| 6,033,021 | A * | 3/2000 | Udo et al. | 297/313 |
| 7,625,046 | B2 * | 12/2009 | Sanchez | 297/353 |
| 2006/0267389 | A1 * | 11/2006 | de Kroon et al. | 297/284.11 |

FOREIGN PATENT DOCUMENTS

| | | | |
|---|---|---|---|
| DE | 10136921 | A1 | 2/2002 |
| EP | 0406707 | A1 | 1/1991 |
| RU | 2020320 | C1 | 9/1994 |
| RU | 2159568 | C1 | 11/2000 |
| RU | 2170539 | C1 | 7/2001 |
| RU | 2199258 | C1 | 2/2003 |
| RU | 2276571 | C1 | 5/2006 |

OTHER PUBLICATIONS

English Translation of International Preliminary Report on Patentability, dated Sep. 30, 2009, from International Application No. PCT/RU2007/000411, filed on Jul. 31, 2007.

* cited by examiner view A-A
from one side

CHAIR (VARIANTS)

RELATED APPLICATIONS

This application is a Continuation of International Application No. PCT/RU2007/000411, filed on Jul. 31, 2007, which claims priority to Russian Patent Application Nos. 2007102451 and 2007102449, both filed on Jan. 23, 2007, all of which are incorporated herein by reference in their entirety.

FIELD OF THE INVENTION

The invention pertains to furniture, and can be used for household applications, at work and leisure, in educational and medical institutions. Since a sedentary life-style is typical of the modern human, it is vital to make sure the furniture whereupon one sits should provide a comfortable position, preserve the physiological spinal bends, maintain the performance of the functional elements of the vertebral column and reduce the negative influence of hypodynamia.

BACKGROUND OF THE INVENTION

A device is known for providing an optimum body posture (ref. Patent RU No. 21 70 539, Class A47C 7/40, A61F 5/34, published on Jul. 20, 2001) that comprises a supporting member of a curvilinear convex shape intended to support the back and to avoid cyphosing of the lumbar spine. The supporting member consists of two layers, either of a symmetrical shape, or in the shape of an aircraft wing, with deflection depth in horizontal cross section ranging from 0 to 50 cm, and with the layer stiffness ratio ranging from 1:1.2 to 1:3.

As regards disadvantages of this device, during operation, activity balance is disturbed of the functional element of the vertebral column, such as muscles, ligaments, and joints, since long fixation of individual functional elements causes their activity reduction, and increases activity of the elements located above the fixation point. Another disadvantage is the static character of the device structure, so that its application for a long time causes hypodynamia.

A device is known for prevention of the human spinal curvature and for training the back muscles in sedentary position (ref. Patent RTJ No. 22.76 571, Class A47C 7/02, A61H 1/00, A63B 23/02, published on May 20, 2006) by means of using a balancing removable seat. The seat comprises a balancing member and a support, whereupon a stand with a pivot is fixed. The pivot links the support with the balancing member.

As regards disadvantages of this device, it is unable to provide the necessary position for the vertebral column, since removable seats modify the structural parameter ratio between the back and the chair, which affects the vertebra support. Another disadvantage is the fact that the seat has no static and comfortable positions, whereby application of this device is limited.

A device is known for providing an optimum human body posture in sedentary position (ref. Patent RU No 21 59 568, Class A47C 1/02, 7/50, published on Nov. 27, 2000) by means of using a knee rest. This device has been used as a prototype for the variants of the chair of the present invention. The arm chair called 'Zdorovie' comprises a base whereupon a telescopic stand is fixed. It is provided with a calf rest with adjustable height, tilt and distance to the seat. The seat features a supporting mechanism for tilt angle adjustment, which comprises a handle and a rest tilted to 20°; it is installed with the center of gravity shifted forward. The base consists of two axes and a cross member that links the center of the front axis with the top of the telescopic stand, and its bottom with the center of the rear axis. Both the axes are provided with roller supports.

As regards disadvantages of this device, it is unable to provide the necessary position for the vertebral column, since there is no back rest. Another disadvantage is the static character of the device' structure, so that its application for a long time causes hypodynamia.

SUMMARY OF THE INVENTION

The objective of the invention is development of a universal design of the dynamic chair that would suit users of any age, reduce hypodynamia, and would be convenient in use.

The technical result includes preservation of the physiological body posture and physiological performance of the functional elements of the vertebral column, and reduction of hypodynamia by means of an optimum load distribution between the elements in sedentary position.

The above technical result, according to the first variant, is achieved by means of the features specified in claim 1, and are common with the prototype, that is, the chair comprises a three-dimensional frame and a seat with lockable height pivotally attached to the frame; by means of essential distinctive features, that is, the chair has a shortened back rest with lockable height to support the vertebral column; the back rest is installed at an angle of less than 90° between its working surface plane and the seat working surface plane; the distance between the top edge of the back rest working surface and the seat plane is less than 250 mm, and the seat is tiltable forward both above and below the horizontal plane, and is provided with an arresting device; besides, there are a smooth displacement compensator of the seat and a reset mechanism installed between the chair frame and the seat.

According to the claim 2, the seat tilt angle ranges from −4° to +16° with respect to the horizontal plane thereof.

According to claim 3, arm rests are installed on the three-dimensional frame.

According to claim 4, the seat arresting device is embodied as inclined frame partitions or stops, for example, studs to be installed on the frame or on the seat.

According to claim 5, the smooth displacement compensator of the seat and the reset mechanism are embodied as a hydropneumatic damper.

The above technical result, according to the second variant, is achieved by means of the features specified in the claim 6, and are common with the prototype, that is, the chair comprises a three-dimensional frame and a seat with lockable height pivotally attached to the frame, and by means of essential distinctive features, that is, the chair has a shortened back rest with lockable height to support the vertebral column; the back rest is installed at an angle of less than 90° between its working surface plane and the seat working surface plane; the distance between the top edge of the back rest working surface and the seat plane is less than 250 mm, and the seat is tiltable forward both above and below the horizontal plane, and is provided with an arresting device; also, there are a smooth displacement compensator of the seat and a reset mechanism installed, embodied in the form of a spring, between the chair frame and the seat.

According to the claim 7, the seat tilt angle ranges from −4° to +16° with respect to the horizontal plane thereof.

According to the claim 8, the seat arresting device is embodied as inclined frame partitions.

The above technical result, in case of the 3$^{rd}$ variant, is achieved by means of the features specified in the claim 9, and are common with the prototype, that is, the chair comprises a three-dimensional frame and a seat with lockable height pivotally attached to the frame, and by means of essential distinctive features, that is, the chair has a shortened back rest with lockable height to support the vertebral column; the back rest is installed at an angle of less than 90° between its working surface plane and the seat working surface plane; the distance between the top edge of the back rest working surface and the seat plane is less than 250 mm, and the seat is tiltable forward both above and below the horizontal plane, and is provided with an arresting device; also, there are a smooth displacement compensator of the seat and a reset mechanism installed between the chair frame and the seat; finally, the back rest and the seat can be fixed in the horizontal plane.

According to the claim 10, the seat tilt angle ranges from −4° to +16° with respect to the horizontal plane thereof.

According to the claim 11, the seat arresting device is embodied in the form of a latch that allows adjusting the seat tilt angle.

According to the claim 12, the smooth displacement compensator of the seat and the reset mechanism are embodied as a hydropneumatic damper provided with a screw to adjust the force produced thereby.

The above technical result, in case of the $4^{th}$ variant, is achieved by means of the features specified in the claim 9, and are common with the prototype, that is, the chair comprises a three-dimensional frame including a telescoping stand, whereupon a seat with lockable height is pivotally attached, and by means of essential distinctive features, that is, the chair has a back rest with lockable height to support the vertebral column; the back rest has two working planes: the tilt angle of the lower working surface with respect to the seat working surface is less than 90°, while the tilt angle of the upper working surface with respect to the seat working surface is 110° or higher; the distance between the top edge of the back rest working surface and the seat plane is over 250 mm, and the seat is tiltable forward both above and below the horizontal plane, and is provided with an arresting device; also, there are a smooth displacement compensator of the seat and a reset mechanism installed between the chair frame and the seat.

According to the claim 14, the seat tilt angle ranges from −4° to +16° with respect to the horizontal plane thereof.

According to the claim 15, the seat arresting device is embodied in the form of a latch that allows adjusting the seat tilt angle.

According to the claim 16, the smooth displacement compensator of the seat and the reset mechanism are embodied as a hydropneumatic damper provided with a screw to adjust the force produced thereby. Below is a description of the cause-and-effect relation between the essential distinctive features and the technical result achieved.

The proposed device allows maintaining a physiological rest position of a sitting person by means of using a back rest tilted to 80° with respect to the seat. Such a tilt provides a physiological rest position of the sacral part of vertebral column, which serves as a basis for the lumbar, thoracic and cervical spine. Therefore, by locking the sacral part in the physiological rest position, similar positions are obtained for the spinal sections above.

In order to maintain normal performance of the spinal functional elements, the back rest is used, whose top edge is located less than 250 mm away from the seat. The shortened back rest locks the sacrum only, which is fixed, while the spinal elements (muscles, ligaments, joints and intervertebral discs) located above the rest are not locked, and therefore, they preserve their natural performance. At the same time, the back rest provides a comfortable support for the vertebral column.

In order to reduce hypodynamia in case of sedentary lifestyle, the seat is used that can be tilted forward with a preset amplitude. If the person sits deeply on the chair, the center of gravity is located beyond the seat pivotal mount axis on the frame, and the seat is fixed in this case. If the person does not sit deeply or bends forward while seated deeply, the center of gravity is located ahead of the seat pivotal mount axis on the frame, whereby the seat tilts forward to 16° below the horizontal plane, until it reaches the arresting device. The selected seat tilt angle provides a comfortable sitting position and facilitates functioning of the muscles that form the correct body posture. Due to smooth changing of the seat position, negative shock loads onto the locomotorium functional elements are avoided; such smoothness is obtained due to the smooth displacement compensator installed between the frame and the seat; the compensator is embodied as a hydropneumatic damper, which is, at the same time, a reset mechanism that returns the seat to its original position. Availability of two standard seat positions allows varying the load, activating the blood flow, and reducing hypodynamia.

For the office staff, a device is proposed that is capable of attaining the above objectives, and, if necessary, of providing a support for the whole vertebral column by means of using an additional section of the back rest. Due to the large angle between the upper and lower parts of the back seat, the person can only lean on the upper seat part by bending far backward; however, in that case, the person must be sitting deeply, to make sure the seat does not tilt forward, whereby the natural spinal bends are maintained. Such a structure provides a comfortable working position, a comfortable relaxing position, and prevents the person from sitting with a bad body posture either in working position, or while resting.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The chair (first variant for home use, FIG. 1.), comprises a three-dimensional frame (1) provided with a seat (2) pivotally attached thereto with lockable height. The chair has a shortened back rest (3) with lockable height to support the vertebral column; the back rest is installed at an angle of less than 90° between its working surface plane and the seat (2) working surface plane; the distance between the top edge of the back rest (3) working surface and the seat (2) plane is less than 250 mm.

Figure 2:
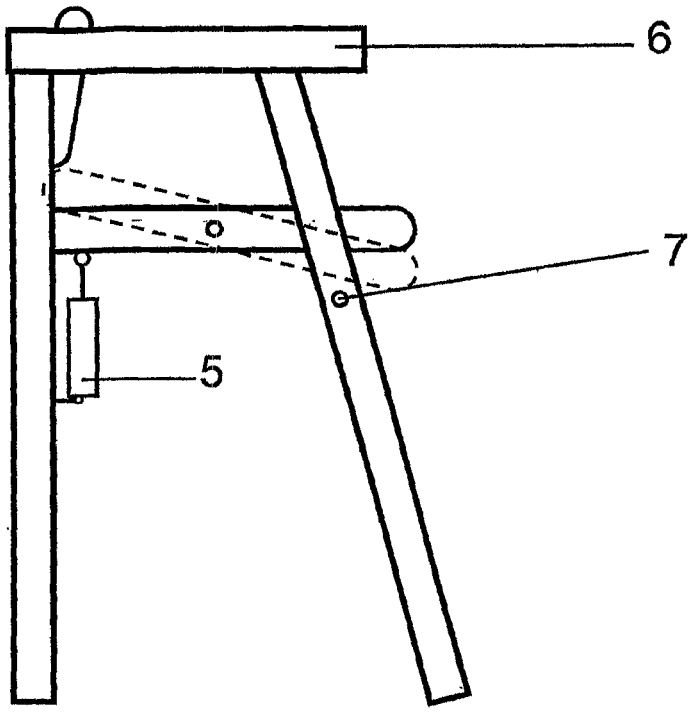
FIG. 2 represents the general view of the home variant provided with arm rests.

The seat (2) is tiltable forward both above and below the horizontal plane (the seat tilt angle ranges from −4° to +16° with respect to the horizontal plane thereof), and is provided with an arresting device (4); also, there is a smooth displacement compensator of the seat and a reset mechanism (5) installed between the chair frame (1) and the seat (2). There are arm rests (6) installed on the three-dimensional frame (1) (FIG. 2).

Figure 2A:
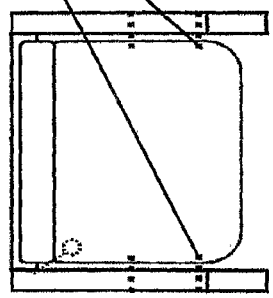
FIG. 2*a* shows the top view of FIG. 2.

The seat arresting device (4) is embodied as inclined frame partitions or stops (7), for example, studs to be installed on the frame (FIG. 2*a*) or on the seat (not shown on the drawing). The smooth displacement compensator of the seat and the reset mechanism (5) is embodied as a hydropneumatic damper.

Figure 1:
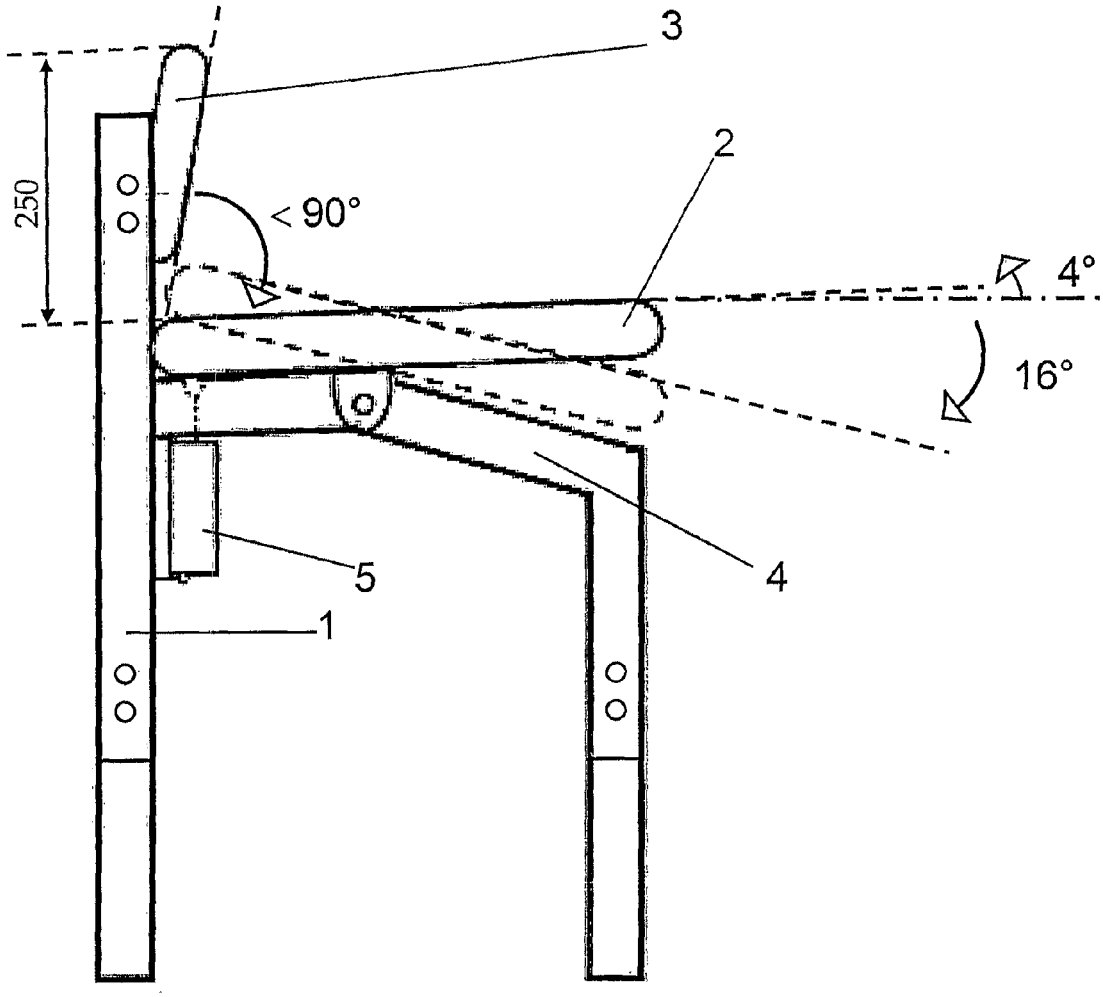
FIG. 1 shows the general view of the home variant of the device.
Figure 1A:
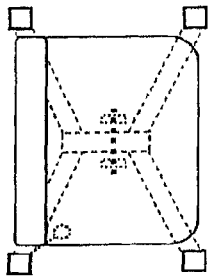
FIG. 1*a* shows the top view of FIG. 1.

The device is used as follows. (FIG. 1). Suppose a person sits down on the chair: if the person is sitting deeply on the seat (2), the center of gravity is located beyond the seat (2) pivotal mount axis on the frame (1), and the seat is fixed; the back rest (3) supports the sacral part of vertebral column and thereby, maintains the correct posture of the spinal sections above, without affecting the performance of their functional elements. If the person's center of gravity is shifted ahead of the seat pivotal mount axis on the frame, which is the case when the person is not sitting deeply on the seat (2), or is bending forward, the seat tilts forward until it reaches the arresting device (4). The selected seat (2) tilt angle) (16°) provides a comfortable sitting position and facilitates functioning of the muscles that form the correct body posture, but it does not interfere with the activity of the spinal functional elements. The smooth displacement compensator (5) installed between the frame (1) and the seat (2) ensures smooth tilting of the seat (2). If the person sits deeply again, and the center of gravity is located beyond the seat (2) pivotal mount axis on the frame, the seat (1) returns to its original position.

Availability of two standard seat (2) positions allows varying the load, activating the blood flow, and reducing hypodynamia, while negative loads are avoided due to the smooth transition from one position to the other. The arm rests (6) ensure the person's comfortable working position on the chair.

Figure 3:
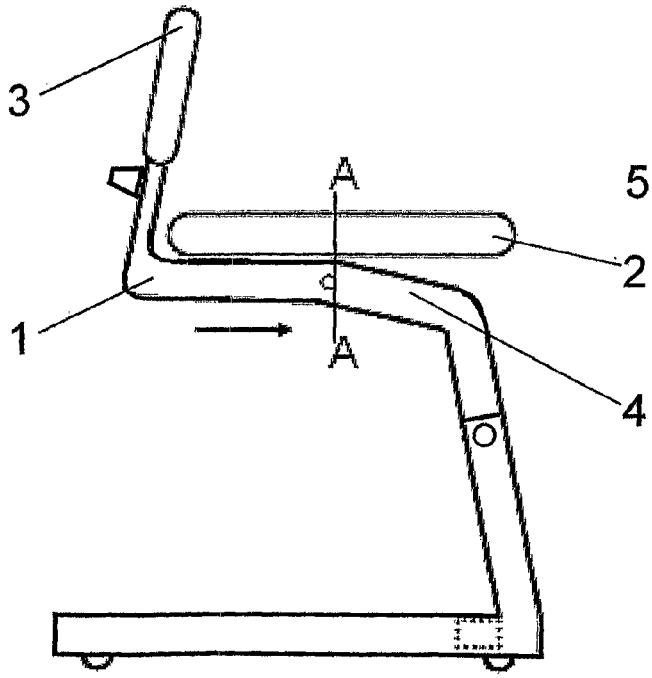
FIG. 3 represents the general view of the school variant of the device, FIG. 3*a* contains the side view A-A.
Figure 3A:
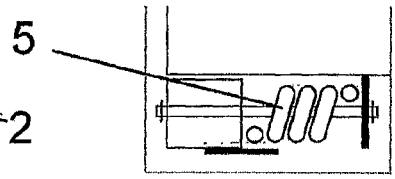
FIG. 3*b* shows the top view of FIG. 3.

The chair (second variant for school use, FIG. 3.), comprises a three-dimensional frame (1) provided with a seat (2) pivotally attached thereto with lockable height. The chair has a shortened back rest (3) with lockable height to support the vertebral column; the back rest is installed at an angle of less than 90° between its working surface plane and the seat (2) working surface plane; the distance between the top edge of the back rest working surface and the seat plane is less than 250 mm. The seat (2) is tiltable forward both above and below the horizontal plane, and is provided with an arresting device (4); also, there is a smooth displacement compensator of the seat and a reset mechanism (5), embodied as a spring and installed between the chair frame and the seat. (FIG. 3*a*).

Figure 3B:
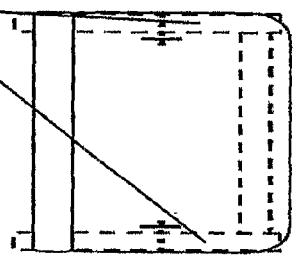

The seat arresting device (4) is embodied as inclined frame partitions (FIG. 3*b*).

The device is used as follows. Suppose a person sits down on the chair: if the person is sits deeply on the seat (2), the center of gravity is located beyond the seat (2) pivotal mount axis on the frame (1), and the seat is fixed; the back rest (3) supports the sacral part of vertebral column and thereby, maintains the correct posture of the spinal sections above, without affecting the performance of their functional elements.

If the person's center of gravity is shifted ahead of the seat (2) pivotal mount axis on the frame (1), which is the case when the person is not sitting deeply on the seat (2), or is bending forward, the seat (2) tilts forward until it reaches the arresting device (4). The selected seat (2) tilt angle) (16°) provides a comfortable sitting position and facilitates functioning of the muscles that form the correct body posture, but it does not interfere with the activity of the spinal functional elements. The smooth displacement compensator (5) installed between the frame and the seat (2) ensures smooth tilting of the seat (2). If the person sits deeply again, and the center of gravity is located beyond the seat (2) pivotal mount axis on the frame, the seat (2) returns to its original position. Availability of two standard seat (2) positions allows varying the load, activating the blood flow, and reducing hypodynamia, while negative loads are avoided due to the smooth transition from one position to the other.

The chair (third variant for child use, FIG. 4.), comprises a three-dimensional frame (1) provided with a seat (2) pivotally attached thereto with lockable height. The chair has a shortened back rest (3) with lockable height to support the vertebral column; the back rest is installed at an angle of less than 90° between its working surface plane and the seat (2) working surface plane; the distance between the top edge of the back rest (3) working surface and the seat (2) plane is less than 250 mm. The seat (2) is tiltable forward both above and below the horizontal plane (the seat tilt angle ranges from −4° to +16° with respect to the horizontal plane thereof), and is provided with an arresting device (4); also, there is a smooth displacement compensator of the seat and a reset mechanism (5) installed between the chair frame and the seat; there are provisions (screws (6)) for locking the back rest and the seat in the horizontal plane.

The seat (2) arresting device (4) is embodied in the form of a latch that allows adjusting the seat tilt angle. The smooth displacement compensator of the seat and the reset mechanism (5) is embodied as a hydropneumatic damper provided with a screw to adjust the force produced thereby.

Figure 4:
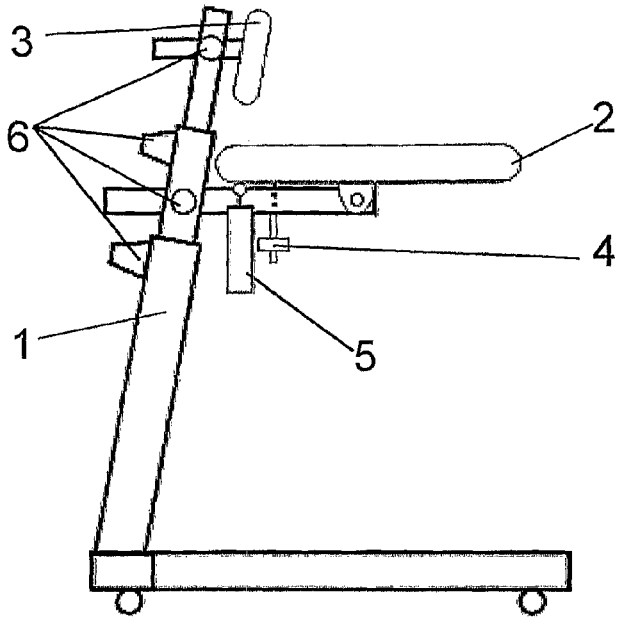
FIG. 4. represents the general view of the child variant of the device.
Figure 4A:
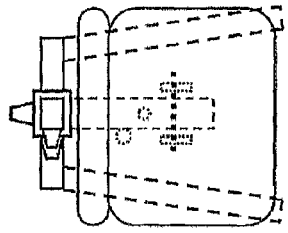
FIG. 4*a* shows the top view of FIG. 4.

The device is used as follows. Depending on the child's height, the horizontal and vertical positions of the seat (2) and the back rest (3) are adjusted by means of the screws (6) so as to ensure a comfortable sitting position (FIG. 4). Adjusting the screw of the hydropneumatic damper (5), the necessary damper force is selected to ensure the seat (2) would tilt forward if the child sat on the edge of the chair. After that, the child sits down on the chair: if it is sitting deeply on the seat (2), the center of gravity is located beyond the seat (2) pivotal mount axis on the frame, and the seat is fixed; the back rest (3) supports the sacral part of vertebral column and thereby, maintains the correct posture of the spinal sections above, without affecting the performance of their functional elements. If the child's center of gravity is shifted ahead of the seat pivotal mount axis on the frame, which is the case when the child is not sitting deeply on the seat (2), or is bending forward, the seat tilts forward until it reaches the arresting device (4). The selected seat (2) tilt angle) (16°) provides a comfortable sitting position for the child and facilitates functioning of the muscles that form the correct body posture, but it does not interfere with the activity of the spinal functional elements. The smooth displacement compensator (5) installed between the frame (1) and the seat (2) ensures smooth tilting of the seat (2). If the child sits deeply again, and the center of gravity is located beyond the seat (2) pivotal mount axis on the frame (1), the seat (2) returns to its original position.

Availability of two standard seat (2) positions allows varying the load, activating the blood flow, and reducing hypodynamia, while negative loads are avoided due to the smooth transition from one position to the other.

Figure 5:
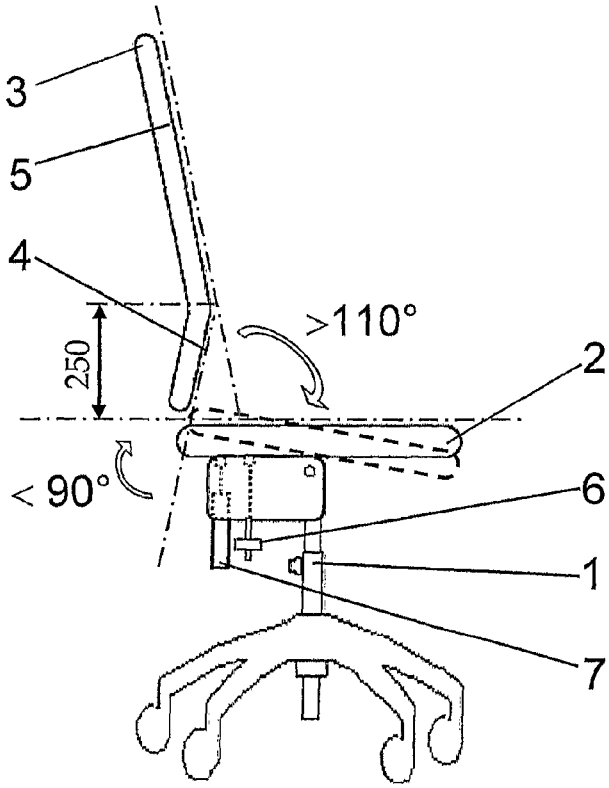
FIG. 5 represents the general view of the office variant of the device.

The chair (fourth variant for office use, FIG. 5.), comprises a three-dimensional frame provided with a telescopic stand (1), a seat (2) pivotally attached thereto with lockable height. The chair has a back rest (3) with lockable height to support the vertebral column; the back rest has two working planes: the tilt angle of the lower working surface (4) with respect to the seat working surface is less than 90°, while the tilt angle of the upper working surface (5) with respect to the seat working surface is 110° or higher; the distance between the top edge of the back rest working surface (5) and the seat (5) plane is over 250 mm. The seat (2) is tiltable forward both above and below the horizontal plane (the seat tilt angle ranges from −4° to +16° with respect to the horizontal plane thereof), and is provided with an arresting device (6); also, there is a smooth displacement compensator of the seat and a reset mechanism (7) installed between the chair frame (1) and the seat (2).

The seat (2) arresting device (6) is embodied in the form of a latch that allows adjusting the seat tilt angle. The smooth displacement compensator of the seat and the reset mechanism (7) is embodied as a hydropneumatic damper provided with a screw to adjust the force produced thereby. The chair is provided with roller supports.

The device is used as follows. Suppose a person sits down on the chair (FIG. 5): if the person is sitting deeply on the seat (2), the center of gravity is located beyond the seat (2) pivotal mount axis on the frame (1), and the seat (2) is fixed; the back rest (3) supports the sacral part of vertebral column and thereby, maintains the correct posture of the spinal sections above, without affecting the performance of their functional elements. If the person's center of gravity is shifted ahead of the seat pivotal mount axis on the frame, which is the case when the person is not sitting deeply on the seat (2), or is bending forward, the seat tilts forward until it reaches the arresting device (6). The selected seat (2) tilt angle) (16°) provides a comfortable sitting position and facilitates functioning of the muscles that form the correct body posture, but it does not interfere with the activity of the spinal functional elements. The smooth displacement compensator (7) installed between the frame (1) and the seat (2) ensures smooth tilting of the seat. If the person sits deeply again, and the center of gravity is located beyond the seat (2) pivotal mount axis on the frame, the seat (1) returns to its original position. Availability of two standard seat (2) positions allows varying the load, activating the blood flow, and reducing hypodynamia, while negative loads are avoided due to the smooth transition from one position to the other. If the person wants to sit back and to take a position wherein the whole vertebral column would be supported, the person will bend far backwards and lean on the upper part of the back rest (3); however, in that case, the person must be sitting deeply, to make sure the seat (2) does not tilt forward, whereby the natural spinal bends are maintained.

The above examples evidence the possibility of realization and intended use of the invention, as described in the Patent Claim thereof.

INDUSTRIAL APPLICABILITY

The invention pertains to furniture, and can be used for household applications, at work and leisure, in educational and medical institutions. The invention is feasible with the use of standard equipment and available materials.

Although this invention has been described by means of implementation examples, the scope of this invention is not limited thereby; it is determined by the Patent Claim only, taking into consideration possible equivalents.

While this invention has been particularly shown and described with references to preferred embodiments thereof, it will be understood by those skilled in the art that various changes in form and details may be made therein without departing from the scope of the invention encompassed by the appended claims.

What is claimed is:

1. A chair comprising a three-dimensional frame and a seat with lockable height pivotally attached to the frame, wherein there is a shortened back rest with lockable height to support the a user's vertebral column;

the back rest is installed at an angle of less than 90° between its working surface plane and the seat working surface plane;

the distance between the top edge of the back rest working surface and the seat plane is less than 250 mm, and the seat is tiltable forward both above and below its horizontal plane, and is provided with an arresting device; and there is a smooth displacement compensator of the seat and a reset mechanism installed between the chair frame and the seat, wherein the range of a seat tilt angle is limited by substantially −4° and +16° with respect to the horizontal plane, and wherein the seat tilt angle is determined by a position of a center of gravity of a person sitting on the seat relative to a seat pivotal mount axis on the frame.

2. The chair according to the claim 1 wherein there are arm rests installed on the three-dimensional frame.

3. The chair according to the claim 1 wherein the seat arresting device is embodied as inclined frame partitions or stops.

4. The chair according to the claim 1 wherein the smooth displacement compensator of the seat and the reset mechanism is embodied as a hydropneumatic damper.

5. A chair comprising a three-dimensional frame and a seat with lockable height pivotally attached to the frame, wherein there is a shortened back rest with lockable height to support the vertebral column;

the back rest is installed at an angle of less than 90° between its working surface plane and the seat working surface plane;

the distance between the top edge of the back rest working surface and the seat plane is less than 250 mm, and the seat is tiltable forward both above and below its horizontal plane, and is provided with an arresting device; and there is a smooth displacement compensator of the seat and a reset mechanism installed, embodied in the form of a spring, between the chair frame and the seat, wherein the range of a seat tilt angle is limited by substantially −4° and +16° with respect to the horizontal plane, and wherein the seat tilt angle is determined by a position of a center of gravity of a person sitting on the seat relative to a seat pivotal mount axis on the frame.

6. The chair according to the claim 5 wherein the seat arresting device is embodied as inclined frame partitions.

7. A chair comprising a three-dimensional frame and a seat with lockable height pivotally attached to the frame, wherein there is a shortened back rest with lockable height to support the vertebral column;

the back rest is installed at an angle of less than 90° between its working surface plane and the seat working surface plane;

the distance between the top edge of the back rest working surface and the seat plane is less than 250 mm, and the seat is tiltable forward both above and below its horizontal plane, and is provided with an arresting device;

and there is a smooth displacement compensator of the seat and a reset mechanism installed between the chair frame and the seat; and the back rest and the seat can be fixed in the horizontal plane, wherein the range of a seat tilt angle is limited by substantially −4° and +16° with respect to the horizontal plane, and wherein the seat tilt angle is determined by a position of a center of gravity of a person sitting on the seat relative to a seat pivotal mount axis on the frame.

8. The chair according to the claim 7 wherein the seat arresting device is embodied in the form of a latch that allows adjusting the seat tilt angle.

9. The chair according to the claim 7 wherein the smooth displacement compensator of the seat and the reset mechanism is embodied as a hydropneumatic damper provided with a screw to adjust the force produced thereby.

10. The chair of claim 1, wherein the arresting device is embodied as studs installed on the frame or on the seat.

* * * * *